US005829350A

United States Patent [19]

Muchi et al.

[11] Patent Number: 5,829,350

[45] Date of Patent: Nov. 3, 1998

[54] PRINTING APPARATUS AND METHOD FOR PRINTING THE INNER SURFACE OF A CYLINDRICAL OBJECT

[75] Inventors: Tsuneo Muchi; Yoshiyuki Noguchi, both of Kanagawa, Japan

[73] Assignee: Sony Corporation, Tokyo, Japan

[21] Appl. No.: 871,374

[22] Filed: Jun. 9, 1997

[30] Foreign Application Priority Data

Jun. 10, 1996 [JP] Japan ..... 8-146905

[51] Int. Cl.[6] ..... B41F 17/14

[52] U.S. Cl. ..... 101/35; 101/41

[58] Field of Search ..... 101/41, 35

[56] References Cited

U.S. PATENT DOCUMENTS 2,071,336 2/1937 Glenn et al. ..... 101/35
4,667,594 5/1987 Eddy ..... 101/35

FOREIGN PATENT DOCUMENTS 116808 7/1946 Denmark ..... 101/35
60-21290 2/1985 Japan ..... 101/35

*Primary Examiner*—Edgar S. Burr
*Assistant Examiner*—Daniel J. Colilla
*Attorney, Agent, or Firm*—Hill & Simpson

[57] ABSTRACT

The printing apparatus has a holding cylinder in which communication holes for communicating an external portion and an internal portion are made and a transfer pad which covers the outer surface of the holding cylinder at ordinary times in a detachable manner, expands upon pressure being applied via the above communication holes when the interior of the holding cylinder is pressurized, and contracts and returns to its original state when the pressure is released. Ink is adhered to the outer surface of the expandable/contractable transfer pad. The transfer pad is inserted in the contracted state into a cylindrical hole of an object to be printed. Pressure is applied from the inside of the transfer pad to cause it to expand and cause the outer surface of the transfer pad to press against the inner surface of the cylindrical hole and thereby transfer the ink adhered to the outer surface of the pad to the inner surface of the cylindrical hole.

13 Claims, 7 Drawing Sheets

PRINTING APPARATUS AND METHOD FOR PRINTING THE INNER SURFACE OF A CYLINDRICAL OBJECT

BACKGROUND OF THE INVENTION

1. Field of the Invention

The present invention relates to a printing apparatus and a printing method for printing an inner surface of a narrow cylilderical tube such as a neck portion of a cathode ray tube by transfer printing.

2. Description of the Related Art

The conventional methods for applying ink or performing printing by the ink on the inner surface of a narrow cylindrical tube such as the neck portion of a cathode ray tube have included, for example, the dispenser system and the ink jet system.

In the dispenser system, a nozzle which is connected to an ink tank and to which the ink is supplied is inserted into the cylindrical tube, pressure is applied to the ink tank to supply the ink to the nozzle, and the ink is applied on the inner surface of the cylindrical tube. In the ink jet system, ink is jetted from a large number of fine pipes in place of the nozzle of the dispenser system.

The above systems are called as direct drawing systems. These generally require a long time for printing a pattern on a large area. Further, where the printing is carried out on the inner surface of a cylindrical tube having a small inner diameter, since a large number of nozzles cannot be inserted into the small inner diameter space, a further longer time is taken to performing the printing. When the cylindrical tube is long, the length of the nozzle also has to be long, so it further suffers from the disadvantage that the ink is apt to clog at the nozzle portion.

SUMMARY OF THE INVENTION

An object of the present invention is to provide a printing apparatus with which the printing can be reliably carried out on the inner surface of a narrow cylindrical tube in a short time.

Another object of the present invention is to provide a printing method with which the printing can be reliably carried out on the inner surface of a narrow cylindrical tube in a short time.

According to a first aspect of the present invention, there is provided a printer apparatus comprising a cylinder shaped transfer pad, a cylinder shaped supporting means having a plurality of holes and inserted into the transfer pad, a positioning stage for positioning the transfer pad and an object to be printed, a sliding means for placing the transfer pad and the supporting means into the object to be printed, and pressing applying means for applying pressure to the transfer pad through the supporting means for causing the outer surface of the transfer pad to contact the inner surface of the object to be printed.

Note that, in the specification, the terms "cylindrical hole", "cylindrical", and "columnar" are wide concepts including also sectional shapes near circles such as ovals.

Preferably, the positioning stage positions the transfer pad and the object to be printed coaxially.

Further, preferably, the transfer pad comprises a material which expands and project when pressure is applied through the holes of the supporting means and which contracts when the pressure is released.

According to a second aspect of the present invention, there is provided a method for printing comprising the steps of applying ink on an outer surface of a cylinder shaped transfer pad, inserting the transfer pad into a cylindrical hole of an object to be printed, and applying pressure to the transfer pad so as to print the inner surface of the hole with ink.

Namely, according to the printing method of the second aspect of the present invention, transfer printing referred to as "pad printing" is applied, where ink is adhered to an outer surface of a cylindrical transfer pad which can be expanded or contracted by applying or releasing pressure Inside In a predetermined pattern, the transfer pad is Inserted Into the columnar cylindrical hole whose Inner surface Is to be printed, and pressure is applied in the transfer pad to cause it to expand and press the outer surface of the pad against the inner surface of the cylindrical hole, whereby the ink adhered to the outer surface of the transfer pad is transferred onto the inner surface of the cylindrical hole.

According to this printing method, the entire inner surface of the cylindrical hole can be printed at one time, therefore the time for printing the inner surface of the cylindrical hole is short. This is particularly advantageous for printing on a large area. Further, it is possible to freely change the printed pattern by changing the pattern of adhesion of the ink on the transfer pad and thus the degree of freedom of the pattern is large.

Preferably, there is further included the step of positioning the transfer pad and the object to be printed coaxially. Further, preferably, the transfer pad is comprised of a material which expands and project when pressure is applied through the holes of the supporting means and which contracts when the pressure is released.

According to a third aspect of the present invention, there is provided a method for printing comprising the steps of inserting a cylinder shaped supporting means having a plurality of holes into a cylinder shaped transfer pad, applying ink on the outer surface of the cylinder shaped transfer pad in a predetermined pattern, positioning the transfer pad and an object to be printed, inserting the transfer pad into a cylindrical hole of the object to be printed, applying pressure to the transfer pad through the supporting means to cause the outer surface of the transfer pad to contact the inner surface of the object to be printed, and pulling out the transfer pad away from the inner surface of the object to be printed after releasing the pressure from the transfer pad Preferably, there is further included the step of positioning the transfer pad and the object to be printed coaxially. Further, preferably, the transfer pad is comprised of a material which expands and project when pressure is applied through the holes of the supporting means and which contracts when the pressure is released.

BRIEF DESCRIPTION OF THE DRAWINGS

The above and other objects and features of the present invention will be more apparent from the following description of the preferred embodiments given with reference to the accompanying drawings, in which:

FIG. 1B is inserted into a cylindrical hole of an object to be printed (work);

DESCRIPTION OF THE PREFERRED EMBODIMENTS

Embodiments of the printing apparatus of the present invention and the methods thereof will be explained below by referring to the attached drawings.

First Embodiment

A first embodiment of the present invention will be described first by referring to FIG. 1A and FIG. 1B to FIG. 7A and FIG. 7B.

Figure 1A:
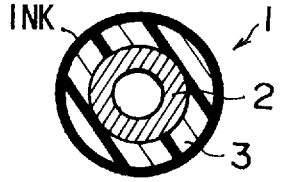
FIG. 1A is a sectional view of a printing apparatus of a first embodiment of the present invention in a direction orthogonal to an axial direction.
Figure 1B:
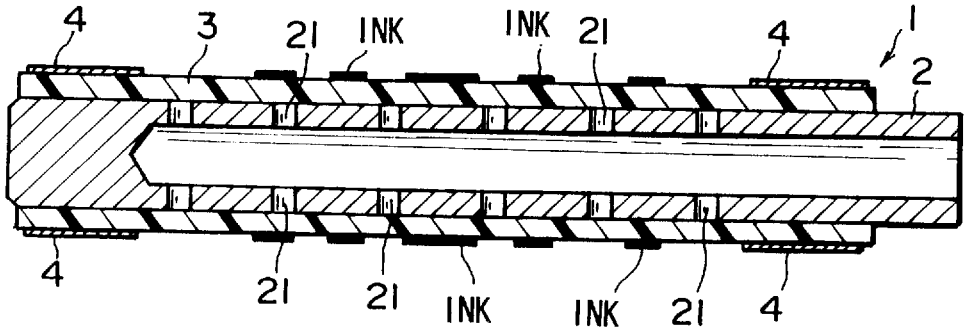
FIG. 1B is a sectional view of the printing apparatus of FIG. 1A in the axial direction.

FIG. 1A is a sectional view of a printing apparatus of the first embodiment of the present invention in a direction orthogonal to an axial direction; and FIG. 1B is a side sectional view along the axial direction.

A printing apparatus 1 has a holding cylinder 2 which is formed by a hard material such as a metal, for example, stainless steel, or a plastic and which has a sealed end, i.e., the one shown at the left in the illustration. The printing apparatus 1 further has a cylindrical transfer pad 3 which comprises a rubber, for example, a silicone rubber, natural rubber, NBR, or SBR, and which usually fits tight over the outer surface of the holding cylinder 2 due to the resiliency of the rubber material. The printing apparatus 1 further has fastening bands 4 made of for example metal at the two end portions of the transfer pad 3 for fastening the end portions of the transfer pad 3 to the holding cylinder 2.

A plurality of communication holes 21 communicating the interior of the holding cylinder 2 with the outer portion are made in the circumferential wall of the holding cylinder 2. When pressure is applied to the interior of the holding cylinder 2 via air, oil, etc. from the open end of the holding cylinder 2, the pressure of the air, oil, etc. is applied to the inner surface of the rubber transfer pad 3 through the plurality of communication holes 21 to make the rubber transfer pad 3 expand away from the holding cylinder 2. Conversely, when the pressure in the holding cylinder 2 is returned to one pascal or the pressure is reduced from one pascal, the transfer pad 3 contracts due to the rubber's resiliency and the inner surface of the transfer pad 3 returns to the state where it comes into close contact with the outer circumferential surface of the holding cylinder 2.

A method of printing the inner surface of a thin circular tube of for example a cathode ray tube using this printing apparatus 1 will be explained next.

Printing ink is applied in a predetermined pattern to the surface of the transfer pad 3 which is not fastened by the fastening bands 4 of the printing apparatus 1 (hereinafter, this will be also referred to as "a valid printing area"). The method of applying the ink will be explained later.

Figure 2:
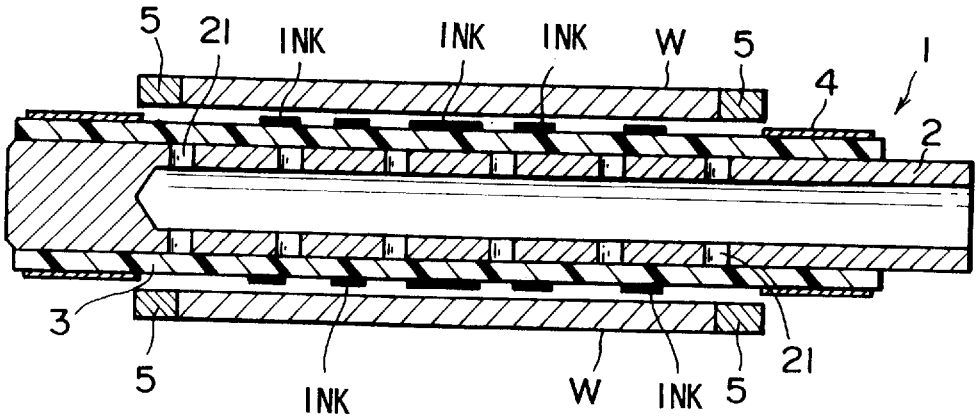
FIG. 2 is a sectional view in the axial direction showing a state where the printing apparatus illustrated in FIG. 1A

FIG. 2 is a sectional view in the axial direction showing a state where the printing apparatus illustrated in FIG. 1A and FIG. 1B is inserted into the cylindrical hole of the object to be printed.

As shown in FIG. 2, the printing apparatus 1 is inserted into the object to be printed, such as the neck of a cathode ray tube, whose inner surface is to be printed, up to the position where the printing should be carried out while coaxially positioning the holding cylinder 2 with the work W so that the transfer pad 3 does not abut against the inner surface of the work W.

Figure 3:
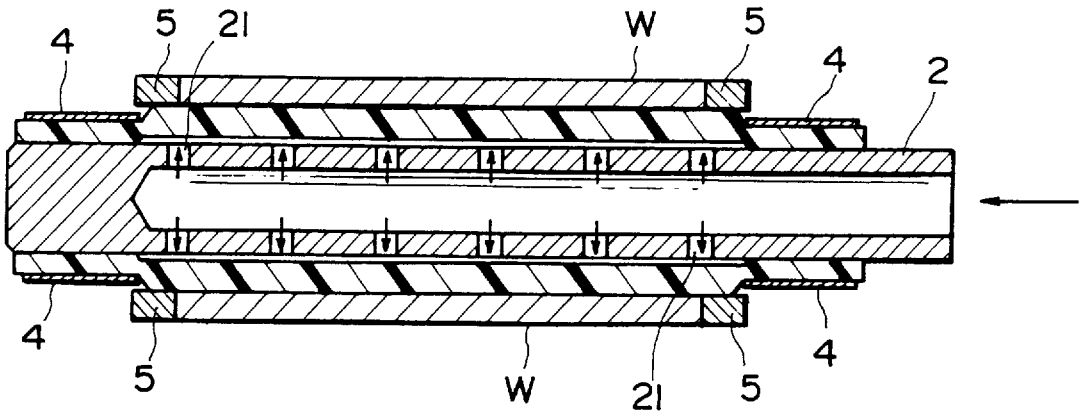
FIG. 3 is a sectional view in the axial direction showing the state where the transfer pad of the printing apparatus of the embodiment of the present invention is expanded and pressed against the inner surface of the work.

FIG. 3 is a sectional view in the axial direction showing a state where the transfer pad of the printing apparatus of the embodiment of the present invention is expanded and pressed against the inner surface of the work.

Then, as shown in FIG. 3, for example, compressed air is sent from the opened portion of the holding cylinder 2. By this, the entire inner surface of the holding cylinder 2 is pressurized and the entire inner surface of the valid area of the transfer pad 3 is pressed through the plurality of communication holes 21. As a result, the transfer pad 3 is expanded by the air pressure, the outer surface of the transfer pad 3 reaches the inner surface of the work W, and then the outer surface of the transfer pad 3 presses against the inner surface of the work W. By this, the ink adhered to the outer surface of the transfer pad 3 is transferred to the inner surface of the work W. At this time, it is also possible to rotate either or both of the holding cylinder 2 or the work W.

Figure 4:
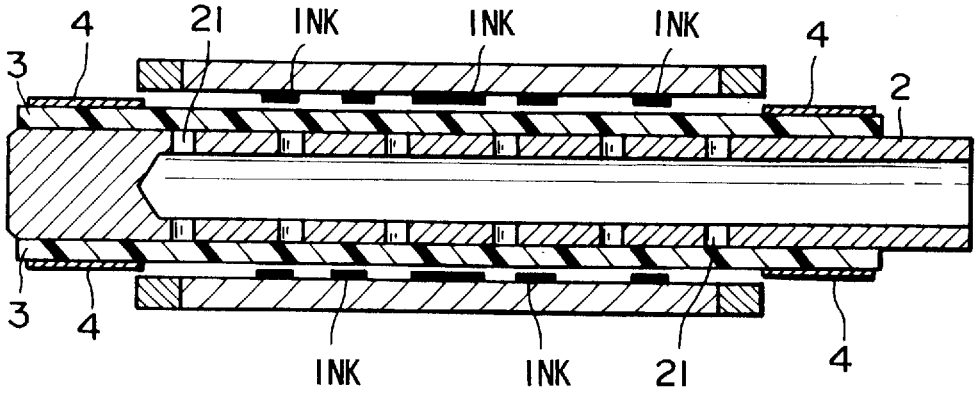
FIG. 4 is a sectional view in the axial direction showing the state immediately after an end of the transfer to the inner surface of the work by using the printing apparatus of the embodiment of the present invention.

FIG. 4 is a sectional view in the axial direction showing the state immediately after the end of the transfer to the inner surface of the work by using the printing apparatus of the embodiment of the present invention.

Figure 5:
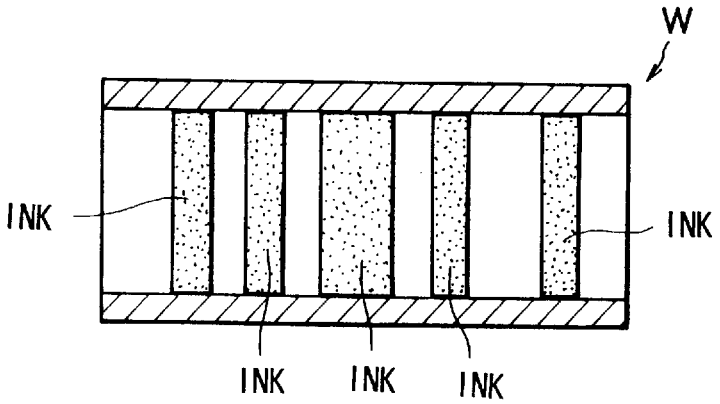
FIG. 5 is a sectional view of the inner surface of work printed according to the embodiment of the present invention.

As shown in FIG. 4, the pressure inside the holding cylinder 2 is then returned to atmospheric pressure, the transfer pad 3 contracts back to its original state so as to come into close contact with the outside of the holding cylinder 2, and the transfer pad 3 returns to its original outer diameter. Next, the printing apparatus 1 is removed from the work W. By this, as shown in FIG. 5, the pattern of the ink adhered to the outer surface of the transfer pad 3 is transferred to the inner surface of the work W. FIG. 5 is a sectional view showing the inner surface of the work printed according to this embodiment of the present invention.

Thereafter, the ink is dried according to need whereby the printing is completed.

Note that, in FIG. 2 to FIG. 4, auxiliary rings 5 having substantially the same inner diameter as the inner diameter of the work are arranged on the two end portions of the work W. These auxiliary rings 5 are for preventing the breakage of the transfer pad 3 due to expansion between the edges of the work W and the fastening bands 4 when the transfer pad 3 expands when the length of the work W is shorter than the valid area of the transfer pad 3. Accordingly, if the work W is longer than the transfer pad 3, the auxiliary rings 5 are unnecessary.

Next, a description will be made of the method for adhering the ink to the transfer pad 3.

Figure 6:
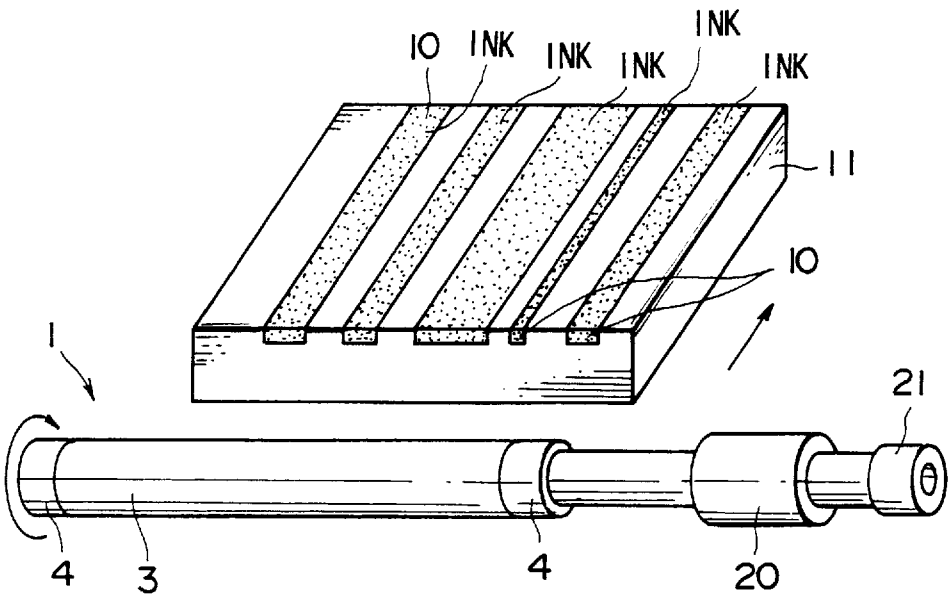
FIG. 6 is a perspective view of the printing apparatus of the embodiment of the present invention and an intaglio plate.

FIG. 6 is a perspective view showing the printing apparatus of the embodiment of the present invention and an intaglio plate.

As shown in FIG. 6, an intaglio plate 11 made of metal, glass, or plastic in which predetermined grooves 10 have been patterned with etching or the like is used. The ink is applied over the entire surface containing the grooves 10, then the excess ink is removed by scraping by for example a doctor blade to leave the ink in just the grooves 10 and, level the surface of the ink. Then, the printing apparatus 1 is rolled on the intaglio plate 11 as indicated by an arrow of FIG. 6 so a predetermined pattern of the ink can be adhered to the surface of the transfer pad 3.

Note that, the holding cylinder 2 of the printing apparatus 1 in FIG. 6 extend held by bearings 20 so that the holding cylinder 2 can rotate about its axis. Further, a rotary air joint 21 is attached to the end portion of the holding cylinder.

The pattern of the grooves 10 of the intaglio plate 11 shown in FIG. 6 is a parallel pattern of grooves used when applying the ink to the transfer pad (inner surface of the work) symmetrically relative to the axis, but in the present invention, the pattern of the grooves 10 is not limited to this.

Figure 7A:
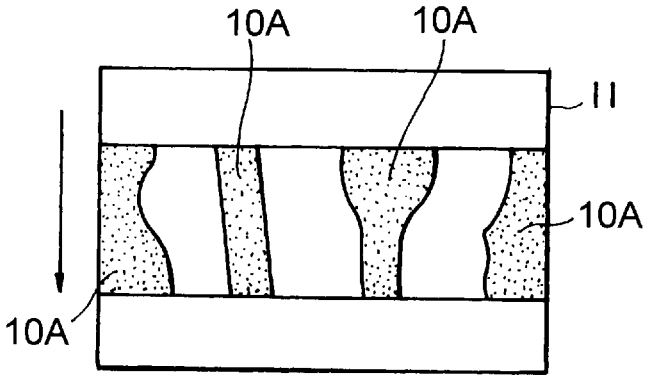
FIG. 7A and FIG. 7B are plan views of the pattern of grooves of an intaglio plate.
Figure 7B:
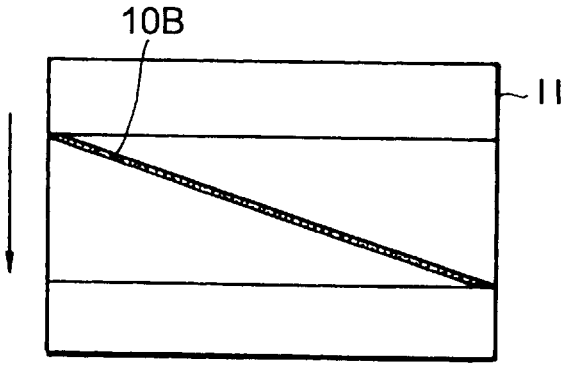

As other patterns of the grooves, as shown in for example FIG. 7A, a pattern of curved grooves 10A can be adopted too. Alternatively, it is also possible to adopt a pattern of a slanted groove 10B as shown in FIG. 7B. If a pattern of a slanted groove 10B of FIG. 7B is used, it is possible to print a spiral pattern on the inner surface of the work. FIG. 7A and FIG. 7B are plan views showing the patterns of the grooves of an intaglio plate.

Note that, even if a waterless plate utilizing the difference of repulsion of ink of a silicone layer and non-silicone layer is used, the ink can be adhered to the transfer pad 3 in the predetermined pattern in exactly the same way as the method using the above intaglio plate 11.

The present invention is not limited to the above embodiment and can be modified in various ways. Other embodiments will be explained below.

Second Embodiment

Figure 8:
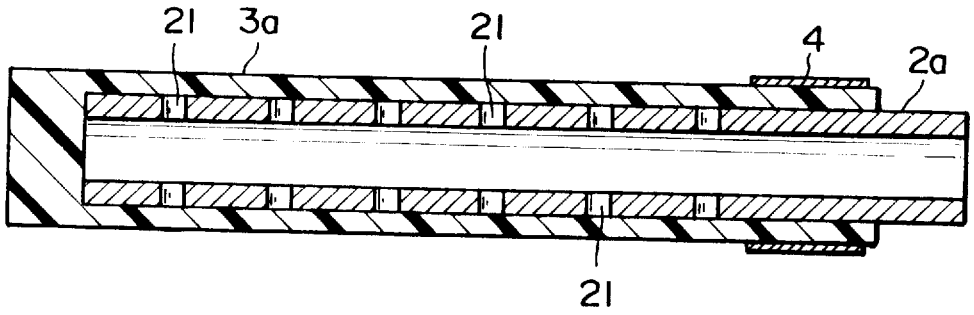
FIG. 8 is a sectional view of the printing apparatus of a second embodiment of the present invention in the axial direction.

FIG. 8 is a sectional view of the printing apparatus of a second embodiment of the present invention in the axial direction.

In the first embodiment, a cylindrical roller 3 with two open ends was used as the transfer pad 3, but, for example, as shown in FIG. 8, a cylindrical roller 3*a* having a closed bottom end may be used as well. Also, as the holding cylinder 2*a,* as shown in FIG. 8, it is possible to use a cylindrical one with two open ends. With this structure, the valid area of the transfer pad 3*a* can be increased.

Third Embodiment

Figure 9:
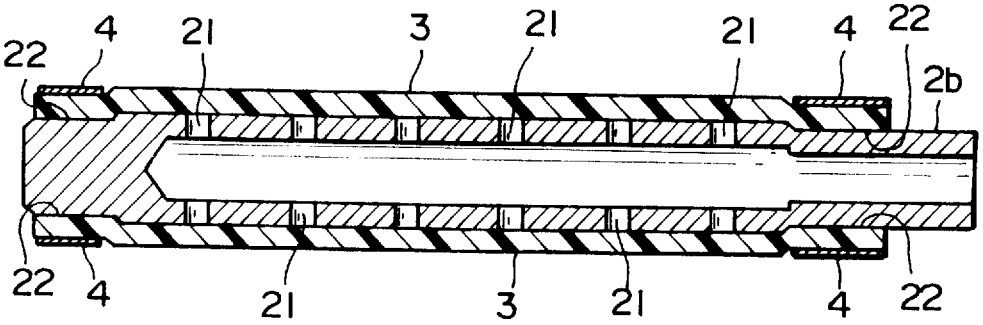
FIG. 9 is a sectional view of the printing apparatus of a third embodiment of the present invention in the axial direction.

FIG. 9 is a sectional view of the printing apparatus of a third embodiment of the present invention in the axial direction.

In the printing apparatus 1 shown in FIG. 1A and FIG. 1B, the fastening bands 4 appear to project slightly from the surface of the transfer pad 3, but in actuality, when the transfer pad 3 is constituted by a rubber roller, when the fastening bands 4 are fastened, the portions of the rubber roller 3 beneath of the fastening bands 4 flex inward, therefore there is substantially no projection in practice. However, in order to more reliably prevent any such projections of the fastening bands 4, as shown in FIG. 9, grooves 22 are formed at the positions for fastening the fastening bands 4 of the holding cylinder 2*b,* whereby the projection of the fastening bands 4 from the transfer pad 3 can be more reliably prevented.

Fourth Embodiment

Figure 10:
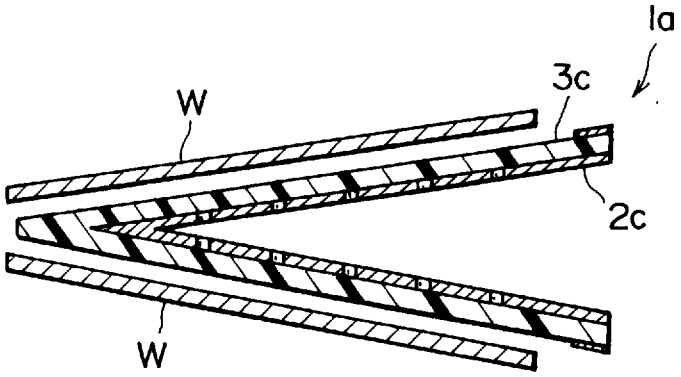
FIG. 10 is a sectional view in the axial direction showing a conical type printing apparatus of a fourth embodiment of the present invention.

FIG. 10 is a sectional view of a conical type printing apparatus of a fourth embodiment of the present invention in the axial direction.

In the first to third embodiments, the printing apparatus was explained as being cylindrical in shape, but the present invention is of course not limited to this. For example, as shown in FIG. 10, by adopting a printing apparatus 1*a* constituted by a conical type or frusto-conical holding cylinder 2*c* and transfer pad 3*c,* the present invention can also be applied to also work W having a tapered hole.

When the above printing is carried out by using the above printing apparatus, the transfer printing can be very quickly carried out on the interior of the cylindrical hole of the object to be printed by an easy operation and in addition a single transfer operation.

Further, in comparison with the conventional dispenser method and ink jet method, according to the printing method of the present embodiment, the disadvantages such as clogging of the ink and a long work time can be solved.

Further, the printing apparat of the embodiments explained above can be made very thin, therefore can be utilized for objects to be printed having narrow cylindrical holes.

Further, the ink can be transferred in a wide range of patterns by using an intaglio plate etc. as described above, therefore the range of application is broad. For example, when the present invention is used for an electron gun of a cathode ray tube in which a grid is formed on the inner surface of for example a cylindrical high resistance conductive ceramic, the formation of the conductive rings for correcting the frame aberration of the side beam can be easily carried out. The range of application is broad, for example, such as patterning a conductive material in the form of a spiral on the inner surface of the neck portion of the cathode ray tube.

Printing System

Below, a brief description will be made of a method for successively performing a step of adhering an ink to the transfer pad in a predetermined pattern, a step of inserting a printing tool into the cylindrical hole of the work, a step of performing the transfer by expanding the transfer pad, a step of causing the transfer pad to contract by releasing the pressure, and a step of removing the printing tool from the work by using the printing apparatus of the embodiments described above by referring to FIG. 11.

Figure 11:
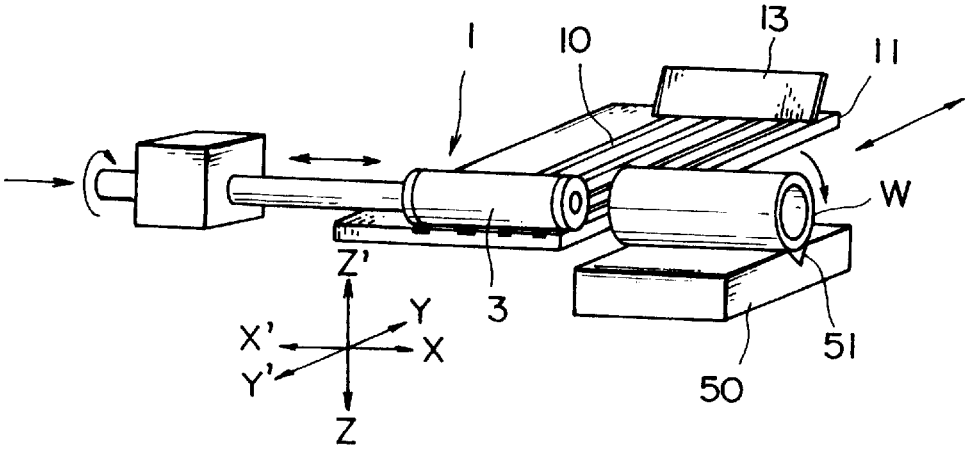
FIG. 11 is a schematic structural view of a printing system using the printing apparatus of an embodiment of the present invention.

FIG. 11 is a schematic structural view of a printing system using the printing apparatus of the embodiment of the present invention.

The printing apparatus shown in FIG. 11 is constituted by a V-block 50 for holding the work, a mechanism (not illustrated) for moving this V-block 50 in an X–X' direction of the figure, the printing apparatus 1, a mechanism (not illustrated) for rotating this, a mechanism (not illustrated) for sending compressed air into the holding cylinder 2 of the printing apparatus 1, an intaglio plate 11, a mechanism (not illustrated) for moving this intaglio plate 11 in a Y–Y' direction, a mechanism (not illustrated) for moving the intaglio plate in a Z–Z' direction, and a doctor blade 13 for scraping off ink from the surface of the intaglio plate.

For example, at the start position, the intaglio plate 11 is beneath the position shown in FIG. 11 and separated from the printing apparatus 1. First, the cylindrical tube type work W whose inner surface is to be printed is affixed to a V-groove 51 of the V-block 50. By this, the work W and the printing apparatus 1 are arranged coaxially. Then, the ink is applied over the intaglio plate 11 including the grooves 10 by the ink supplying apparatus by a not illustrated roller or the like. Excess ink is scraped off by the doctor blade 13. Thereafter, the intaglio plate 11 is moved upward so that the surface of the intaglio plate 11 and the transfer roll 3 of the printing apparatus 1 contact each other. Next, the printing apparatus 1 is rotated in synchronization with the intaglio plate 11 while moving the intaglio plate 11 in the Y' direction. The ink pattern of the intaglio plate 11 is transferred to the printing apparatus 1 by this so that the ink is adhered to the transfer pad 3 in a predetermined pattern. Then, the intaglio plate 11 is moved downward (Z-direction) and spaced from the printing apparatus 1. Then, the V-block 50 is moved in the X' direction and the printing apparatus 1 is arranged inside the cylindrical hole of the work W. Next, pressure is applied to the interior of the printing apparatus 1 by a compressor or compressed gas or other pressurized gas from a pressurized gas apparatus and the transfer pad 3 is expanded. By this, the transfer pad 3 presses against the inner surface of the work W so as to transfer the ink adhered to the surface of the transfer pad 3 to the inner surface of the work W. Next, the pressure in the printing apparatus 1 is returned to the atmospheric pressure by switching for example a valve. By this, the transfer pad 3 contracts and returns to the original state where the transfer pad 3 is separated from the inner surface of the work W. Next, the V-block 50 is moved in the X-direction to remove the transfer pad 3 from the work W. By this, the transfer step is completed. By automation of the removal of the work to which the transfer is completed and the attachment of new work etc., the transfer printing can be carried out with a high efficiency.

In the above embodiments, the explanation was made by using as an example printing on the inner surface of a cylinder etc., but the printing apparatus of the present invention can be also applied to a case where for example a transfer sheet is adhered to the transfer pad and this is transferred to the inner surface of the work or a predetermined pattern is supplied from another roll and this is printed on a flat work since the characterizing feature of the invention lies in the mechanism for expanding the transfer pad and enlarging its outer diameter.

As mentioned above, according to the printing apparatus of the present invention, the ink can be transferred to the inner surface of a cylindrical hole of work on which printing with a high efficiency is usually difficult.

Further, according to the printing method of the present invention, the inner surface of a cylindrical hole of work on which printing is usually difficult can be quickly printed.

We claim:

1. A printer apparatus comprising:

a transfer pad, a support member having a plurality of holes inserted into the transfer pad, wherein the transfer pad is secured to the support member and the member has at least one groove with a fastening band formed over the transfer pad above the groove; and a pressure applying means for applying pressure to the transfer pad through the support member for causing the outer surface of the transfer pad to contact the inner surface of the object to be printed.

2. A printer apparatus as set forth in claim 1, wherein the transfer pad comprises a material which expands and projects when pressure is applied through the holes of the supporting means and which contracts when the pressure is released.

3. The printer apparatus of claim 1, further comprising an auxiliary ring adjacent the object to be printed.

4. The printer apparatus of claim 1, wherein the support member is substantially cylindrical.

5. The printer apparatus of claim 1, wherein the support member is substantially conical.

6. A method for printing comprising the steps of:

applying ink on an outer surface of a transfer pad, providing a support member having at least one groove, fastening the transfer pad to the support member by means of a band formed over the transfer pad above the groove, inserting the transfer pad into a hole of an object to be printed, and applying pressure to the transfer pad so as to print the inner surface of the hole with ink.

7. A method for printing as set forth in claim 6, comprising the additional step of positioning the transfer pad and the object to be printed coaxially.

8. A method for printing as set forth in claim 6, comprising the additional steps of providing holes in the supporting means, and constructing the transfer pad of a material which expands and projects when pressure is applied through the holes of the supporting member and which contracts when the pressure is released.

9. The printer apparatus of claim 6, wherein the support member is substantially cylindrical.

10. The printer apparatus of claim 6, wherein the support member is substantially conical.

11. A method of printing comprising the steps of:

providing a cylinder shaped support means having at least one groove and a plurality of holes, inserting the cylinder shaped supporting means into a cylinder shaped transfer pad, fastening the transfer pad to the supporting means by means of a band formed over the transfer pad above the groove, applying ink on the outer surface of the cylinder shaped transfer pad in a predetermined pattern, and applying pressure to the transfer pad through the supporting means to cause an outer surface of the transfer pad to contact the inner surface of the object to be printed.

12. A method for printing as set forth in claim 11, comprising the step of positioning the transfer pad and the object to be printed coaxially.

13. A method for printing as set forth in claim 11, including the step of constructing the transfer pad of a material which expands and projects when pressure is applied through holes of the supporting means and which contracts when the pressure is released.

* * * * *